United States Patent [19]

Honda et al.

[11] Patent Number: 4,938,806

[45] Date of Patent: Jul. 3, 1990

[54] METHOD FOR PRODUCING AN ELECTRO-MAGNETIC STEEL SHEET

[75] Inventors: Atsuhito Honda, Chiba; Michiro Komatsubara, Kurashiki; Ko Matsumura, Chiba, all of Japan

[73] Assignee: Kawasaki Steel Corporation, Hyogo, Japan

[21] Appl. No.: 208,034

[22] Filed: Jun. 17, 1988

[30] Foreign Application Priority Data

Jun. 23, 1987 [JP] Japan ..... 62-154289
Jun. 23, 1987 [JP] Japan ..... 62-154290

[51] Int. Cl.[5] ..... B21B 1/22; B21H 8/02

[52] U.S. Cl. ..... 148/111; 148/120; 72/366.2; 72/252.5

[58] Field of Search ..... 148/111, 120; 72/365, 72/366

[56] References Cited

FOREIGN PATENT DOCUMENTS

| | | | |
|---|---|---|---|
| 253366 | 1/1988 | European Pat. Off. | 72/366 |
| 51942 | 1/1976 | Japan . | |
| 109815 | 9/1978 | Japan . | |
| 109815 | 9/1978 | Japan . | |
| 104155 | 6/1983 | Japan | 72/365 |

*Primary Examiner*—John P. Sheehan
*Assistant Examiner*—George Wyszomierski
*Attorney, Agent, or Firm*—Oliff & Berridge

[57] ABSTRACT

When producing a semi-process electromagnetic steel sheet by a series of process steps including cold rolling, annealing and skin pass rolling, in this order, a hot rolled sheet containing not more than 0.02 wt. % of C, 0.1 to 1.0 wt. % of Si, 0.5 to 1.5 wt. % of Mn, 0.1 to 0.6 wt. % of Al and 0.02 to 0.10 wt. % of P and optionally containing at least one of 0.1 to 1.0 wt.% of Ni, 0.01 to 0.2 wt. % in sum of Sb and/or Sn, and not more than 0.6 wt. % of Cu, the semi-process electromagnetic steel sheet excellent in magnetic properties along the circumferential direction is obtained when a roll in which a number of craters each having a diameter of an equivalent circle of the crater of not larger than 200 microns are formed on the roll surface and a level difference between the most protuberant and recessed portions is in the range from 5 to 40 miclons, with the number of craters per square centimeter being not less than 1000 and none of the craters overlapping with an adjoining crater or craters, is used as the roll for skin pass rolling. The semi-process electromagnetic steel sheet excellent in anti-sticking properties and in magnetic properties along the rolling direction is obtained when a roll in which a number of craters each having a diameter of an equivalent circle of the crater of not larger than 500 microns are formed on the roll surface and a level difference between the most protuberant and most recessed portions of the crater is in the range from 5 to 40 microns, with the number of the craters per square centimeter being in the range from 1 to 400 and none of the craters overlapping with an adjoining crater or craters, is used as the roll for the skin pass rolling.

4 Claims, 4 Drawing Sheets

METHOD FOR PRODUCING AN ELECTRO-MAGNETIC STEEL SHEET

BACKGROUND OF THE INVENTION

This invention relates to a method for producing a semi-processed electro-magnetic steel sheet or strip excellent in magnetic properties in the circumferential direction and advantageously employed as the core material for a small-sized electric motor, and a semi-processed electro-magnetic steel sheet excellent in anti-sticking properties and in magnetic properties along the rolling direction.

The semi-processed electro-magnetic steel sheets are mainly employed as the core material for small-sized transformers, electric motors and stabilizers for fluorescent lamps. Recently, in view of the general tendency towards energy saving, an increasing demand is presented for low iron losses and high magnetic permeability.

In small-sized stabilizers and small-sized transformers, in which the direction of the magnetic flux is mainly along the rolling direction of the material, it is preferred that the material exhibits strong anisotropy and good magnetic properties in the rolling direction.

In rotational machines, such as the electric motors, it is preferred that the material has a low anisotropy as the magnetic properties and excellent magnetic properties in the circumferential direction.

As such core material for rotational machines, the Japanese Patent Publication KOKOKU No. 51-942 discloses an in-plane non-oriented magnetic steel sheet having an aggregate texture of [100]<OVW However, in the preparation of the above steel sheet, it is necessary that the hot-rolled sheet be 2.0 to 5.0 mm thick and the reduction ratio for cold rolling be as large as 85 percent or higher, so that the cold rolling performance is exceedingly lowered. Also, because of these constraints of the rolled sheet thickness and the reduction ratio, the product thickness was necessarily limited to not more than 0.35 mm, which represents a drawback of the prior-art steel sheet.

It is an object of the present invention to overcome the above problem and to provide a method for advantageously producing a semi-processed electro-magnetic sheet excellent in the magnetic properties along the circumferential direction without constraints of the reduction ratio and the thickness of the hot-rolled sheet.

Heretofore, an equal number of the 28 cm×3 cm epstein samples was usually taken along the rolling direction and in the direction orthogonal to the rolling direction for measuring and evaluating the properties of the electromagnetic steel sheet. This method however has a drawback that, while the magnetic properties can be evaluated in the rolling direction and in the direction orthogonal to the rolling direction, information concerning the magnetic properties in the circumferential direction, required of the dynamoelectric machines, such as the electric moters, cannot be obtained accurately.

In view of the above drawback of the prior art, the present invention is also aimed to provide a method for producing magnetic steel sheet having improved cold rolling properties and various sheet thicknesses. Also, as the method for more reasonable evaluation of the core material for rotational machines, such as the electric motors, there is adopted a method for evaluating the magnetic properties along the circumferential direction using ring-shaped test pieces.

On the other hand, strong anisotropy in the magnetic properties and excellent magnetic properties in the rolling direction are required of small-sized stabilizers in which the magnetic fluxes mainly flow in the rolling direction of the sheet material.

For example, it is reported in the Japanese Patent Application KOKAI No. 53-109815 that a magnetic steel sheet having the magnetic permeability in the rolling direction $\mu 15/50$ of not lower than 4500 may be obtained for the r.m.s. value of the surface roughness after the skin pass rolling of not larger than 15 microinches.

However, because of the lower surface roughness of the steel sheet obtained by the above prior art method, there is presented a problem that the stacked steel sheets become fused or stuck to one another at the time of stress relief annealing at the user's plant.

For simply avoiding such sticking, it suffices that the steel sheet surface be rough such that the r.m.s. value of the surface roughness be not less than 40 microinches. However, in this case, the magnetic permeability in the rolling direction is necessarily and unavoidably lowered.

The present invention provides a solution of the above problem advantageously and is also aimed to provide a method for producing a semi-process electro-magnetic steel sheet excellent not only in anti-sticking performance but also in the magnetic properties, above all, in the magnetic properties in the rolling direction.

SUMMARY OF THE INVENTION

The process of evolution of the present invention will be hereafter explained.

Heretofore, for imparting roughness to the surface of the cold rolled steel sheet, the roll surface was ground or rigid sand or balls were projected on the roll surface to control the roughness of the roll surface and the produced roughed roll surface was transferred to the steel surface by rolling. Thus the roughness imparted to the steel sheet is necessarily in a dis-ordered state and lacks in periodicity.

The present inventors conducted various researches in this respect and found that the periodicity in the predetermined patterns and dimension of projections and recesses transferred to the steel sheet significantly influences the magnetic properties of the steel sheet along the circumferential direction and the rolling direction thereof.

Thus the present inventors have found that satisfactory magnetic properties along the circumferential direction of the steel sheet may be obtained when the patterns of the projection and recesses transferred to the steel sheet are preferably circular or elliptical in shape and of a predetermined specific size and are distributed periodically without overlapping on one another.

Moreover the present inventors have found that high magnetic permeability along the rolling direction of the steel sheet and extremely satisfactory anti-sticking properties at the time of stress relief annealing may be obtained when the patterns of the projection and recesses transferred to the steel sheet are preferably circular or elliptical in shape and of a predetermined specific size and are distributed periodically without overlapping one another.

In accordance with the first aspect of the present invention, there is provided in a method for producing a semi-processed electomagnetic steel sheet excellent in magnetic properties along a circumferential direction by a series of process steps including cold rolling, annealing and skin pass rolling, in this order, a hot-rolled steel sheet containing not more than 0.02 wt. % of C, 0.1 to 1.0 wt. % of Si, 0.5 to 1.5 wt. % of Mn, 0.1 to 0.6 wt. % of Al and 0.02 to 0.10 wt. % of P, wherein the improvement resides in that a roll in which a number of craters each having a diameter of an equivalent circle of not larger than 200 microns are formed on the roll surface and in which a level difference between the most protuberant and the most recessed portions of each of said craters is in the range from 5 to 40 microns, the number of the craters per square centimeter being not less than 1000 and none of the craters overlapping with an adjoining crater or craters, is used as the roll for the skin pass rolling step.

In accordance with the second aspect of the present invention, there is also provided a method for producing a semi-processed electromagnetic steel sheet excellent in anti-sticking properties and in magnetic properties along the rolling direction by series of process steps including cold rolling, annealing and skin pass rolling, in this order, a hot-rolled steel sheet containing not more than 0.02 wt. % of C, 0.1 to 1.0 wt. % of Si, 0.5 to 1.5 wt. % of Mn, 0.1 to 0.6 wt. % of Al and 0.02 to 0.10 wt. % of P, wherein the improvement resides in that a roll in which a number of craters each having a diameter of an equivalent circle of 30 to 500 microns, are formed on the roll surface, and in which a level difference between the most protuberant and most recessed portions of each of said craters is in the range from 5 to 40 microns, with the number of the craters per square centimeter being in the range from 1 to 400 and none of the craters overlapping with an adjoining crater or craters, is used as the roll for the skin pass rolling step.

In these aspects of the present invention, preferably said hot-rolled sheet further contains at least one element selected from the group consisting of Ni in an amount of 0.1 to 1.0 wt. %, Sb and/or Sn in an amount in sum of 0.01 to 0.2 wt. % and Cu in an amount of not more than 0.6 wt. %.

DETAILED DESCRIPTION OF THE INVENTION

Figure 1:
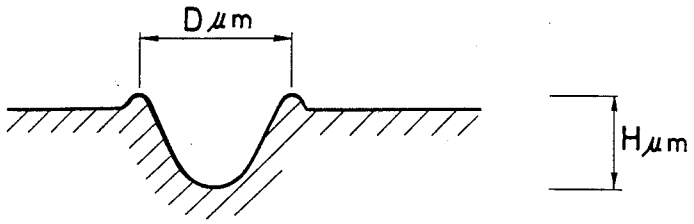
FIG. 1 is a diagrammatic cross-sectional view of a crater formed on the skin pass roll surface.

The present invention will be explained hereafter in more detail.

The reason of limiting the composition of the essential components of the steel sheet or strip material in the first and second embodiments of the present invention is as follows.

C: not higher than 0.02 wt. %

The element carbon (C) deteriorates iron losses and magnetic permeability, so that it is preferably used in as small an amount as possible. However, the contents of C of not higher than 0.020 wt. % may be accepted.

Si: 0.1 to 1.0 wt. %

The element silicon (Si) elevates the specific resistance, while lowering eddy current losses, so that the contents of Si of not lower than 0.1 wt. % percent result in deteriorated magnetic permeability.

For this reason, the contents of Si are selected to be in the range of 0.1 to 1.0 wt. %.

Mn: 0.5 to 1.5 wt. %

The element manganese (Mn) in an amount of not lower than 0.5 wt. % is required for elevating the specific resistance. However, with the manganese contents in excess of 1.5 wt. %, the grain growth is restrained and the magnetic properties are lowered. For this reason, the contents of Mn are selected to be in the range of 0.5 to 1 5 wt. %.

Al: 0.1 to 0.6 wt. %.

The element aluminium (Al), similarly to Si and Mn, elevates the specific resistance, so that the amount of Al of not less than 0.1 wt. % is required. However, with the amount of Al in excess of 0.6 wt. %, magnetic permeability is deteriorated. For this reason, the contents of Al are selected to be in the range of 0.1 to 0.6 wt. %.

P: 0.02 to 0.10 wt. %

The element phosphorus (P) in an amount not lower than 0.02 wt. % is required to exhibit the effect in lowering iron losses. However, with the contents of P in excess of 0.10 wt. %, magnetic permeability is deteriorated. For this reason, the contents of P in the range of 0.02 to 0.10 wt. % are preferred.

Although the foregoing description has been made with reference to the essential components, surface oxidation and nitrization inhibitors, such as Sb or Sn, and specific resistance improvers, such as Cu or Ni, may be selectively added within the scope of the present invention. The reason of limiting the amounts of these optionally added elements to the above range will now be explained.

Ni: 0.1 to 1.0 wt. %

The element nickel (Ni) is useful to evolve a texture desirable from the viewpoint of magnetic characteristics. Since this desirable effect is almost nil with the Ni contents less than 0.1 wt. %, while with the contents of Ni in excess of 1.0 wt. % the reduction in the iron losses and the increase in magnetic permeability are negligible in contrast to the increase in the cost of addition For this reason, the amount of Ni is limited so as to be not less than 0.1 wt. % and not more than 1.0 wt. %.

One or more of Sb and Sn: 0.01 wt. % to 0.2 wt. %

The elements antimony (Sb) and tin (Sn) may also be added since these elements are effective to prevent surface oxidation and nitrization. The effect of these elements are almost nil with the amounts less then 0.01 wt. %, while the magnetic properties are deteriorated with the amounts of these elements in excess of 0.2 wt. %.

Cu: not higher than 0.6 wt. %

The element copper (Cu) may also be added since it is effective to elevate the specific resistance while lowering eddy current losses. However, with the contents of Cu in excess of 0.6 wt. %, magnetic permeability is lowered. The problem of hot brittleness presented with the addition alone of Cu may be satisfactorily dissolved when Ni is also contained in an amount not lower than 0.1 wt. %, since Ni is effective to elevate the melting point of Cu.

The hot rolled sheet having the above defined preferred composition is directly old rolled or cold rolled after anealing; at a temperature of not lower than about 700° C. as the occasion may require, then annealed at a temperature of not lower than about 600° C. and subjected to skin pass rolling at a reduction ratio of the order of 3 to 10 percent to a desired product. It is this skin pass rolling step that is of utmost importance in the process of the present invention.

FIG. 1 diagrammatically shows the cross-section of a localized surface area of a skin pass roll employed in the first and second embodiments of the present invention. The crater formed on the roll surface has a diameter D of an equivalent circle in microns and the difference H between the most protuberant and recessed portions in microns. The number of the craters in a square centimeter ($cm^2$) of the roll surface is expressed as N.

It is noted that the above craters are formed by laser machining and are arrayed regularly at equal intervals along the peripheral and axial directions of the roll and in the form of a two-dimensional crystal lattice.

The first embodiment of the present invention is now explained.

Figure 2:
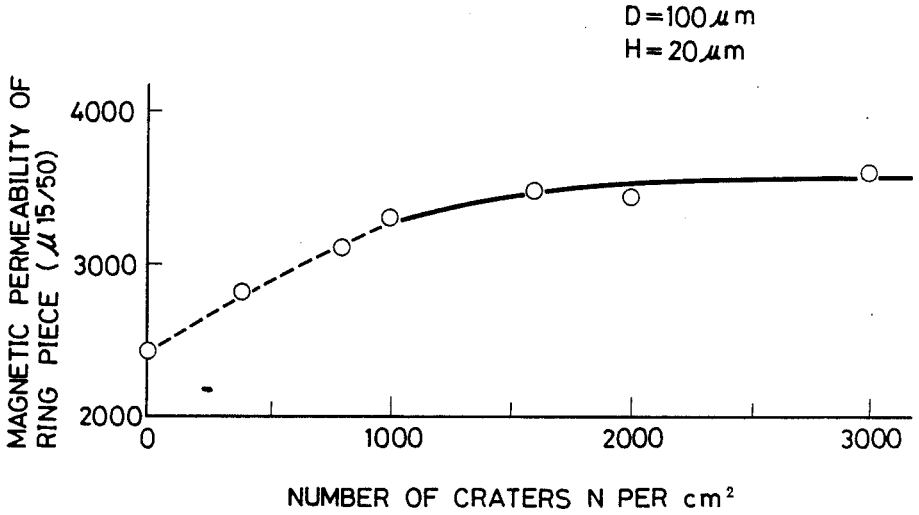
FIG. 2 is a chart showing the relation between the number of the craters N and the magnetic permeability of the ring-shaped test pieces $\mu 15/50$ in the first aspect of the invention.

FIG. 2 shows the relation between the magnetic permeability $\mu 15/50$ in the circumferential direction of the steel sheet and the number of the craters N, for D=100 microns and H=20 microns, as mean values.

For producing a specimen, a hot-rolled sheet having the composition of 0.004% of C, 0.5% of Si, 1.10% of Mn, 0.2% of Al, 0.04% of P and the balance being substantially Fe, is cold-rolled to a thickness of 0.53 mm, then annealed at 800° C. and subjected to skin pass rolling at a reduction ratio of 5 percent. The rolled sheet thus obtained was punched to a ring shaped test piece having the outside diameter of 100 mm and an inside diameter of 50 mm and then subjected to a stress relief annealing for 2 hours at 750° C. in a nitrogen atmosphere. The magnetic permeability of the produced ring-shaped test piece was then measured.

It is seen from FIG. 2 that the larger the number N, the higher is the magnetic permeability $\mu 15/50$ along the circumferential direction and that the excellent magnetic permeability is realized in the range of $N \geqq 1000$.

Figure 3:
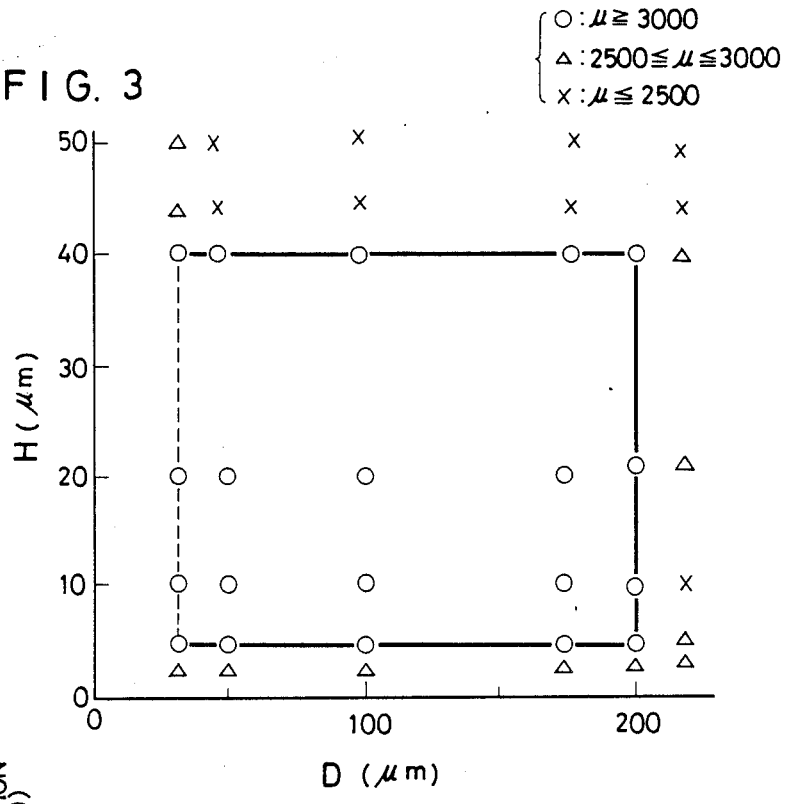
FIG. 3 is a chart illustrating the effect of the diameter of an equivalent circle of a crater D and the level difference between the most protuberant portion and the most recessed portion of the crater H on the magnetic permeability in the first aspect of the present invention.

FIG. 3 shows in an ordered fashion the results of investigations into the values of $\mu 15/50$ for various values of the diameter of the equivalent circle D of the crater and of the difference H between the most protuberent and most recessed portions of the crater, for a constant value of the number of craters N of 1600.

It is seen from this figure that highly satisfactory values of $\mu 15/50$ are obtained for the range $D \leqq 200$ microns and H=5 to 40 microns.

It is for this reason that the numerical limitations of $D \leqq 200$ microns, H=5 to 40 microns and $N \geqq 1000$ have been adopted for the craters that are to be formed on the surface of the skin pass roll. Since D of less then 30 microns is extremely difficult to realize in the practical formation of the craters, it is more practical that the value of D be set so as to be not less than 30 microns.

The second embodiment of the present invention will be explained.

Figure 4:
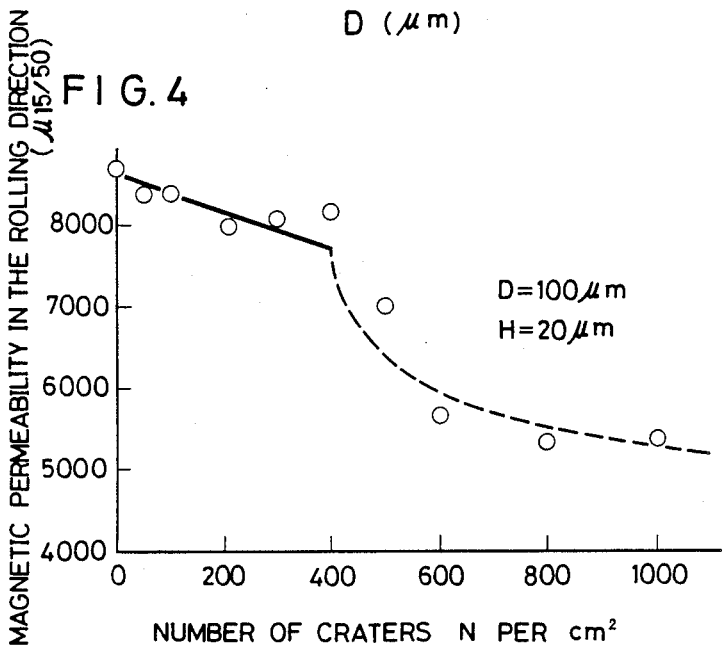
FIG. 4 is a chart illustrating the relation between the number of the craters N and the magnetic permeability $\mu 15/50$ in the rolling direction of the steel sheet in the second aspect of the present invention.

FIG. 4 shows the relation between the number of the craters N and magnetic permeability $\mu 15/50$ along the rolling direction of the steel sheet, for D=100 microns and H=20 microns, as mean values.

In preparing the specimen or test piece, a hot-rolled sheet having the composition of 0.005% of C, 0.5% of Si, 1.10% of Mn, 0.37% of Al and 0.04% of P, with the balance being mainly Fe, is cold-rolled up to a thickness of 0.53 mm, then annealed at 800° C. and subjected to skin pass rolling at a reduction ratio of 5%.

The rolled sheet thus produced is cut to an epstein size sheet 30 mm in width and 280 mm in length and subjected to stress relief annealing in a nitrogen environment at 750° C. for two hours. The magnetic permeability of the epstein size sheet was then measured.

It is seen from FIG. 4 that the larger the number N, the more acutely the magnetic permeability along the rolling direction is deteriorated, and that the tendency towards such deterioration is outstanding especially for $N \geqq 400$. The number N of not less than 1 at least is required in view of anti-sticking properties.

Figure 5:
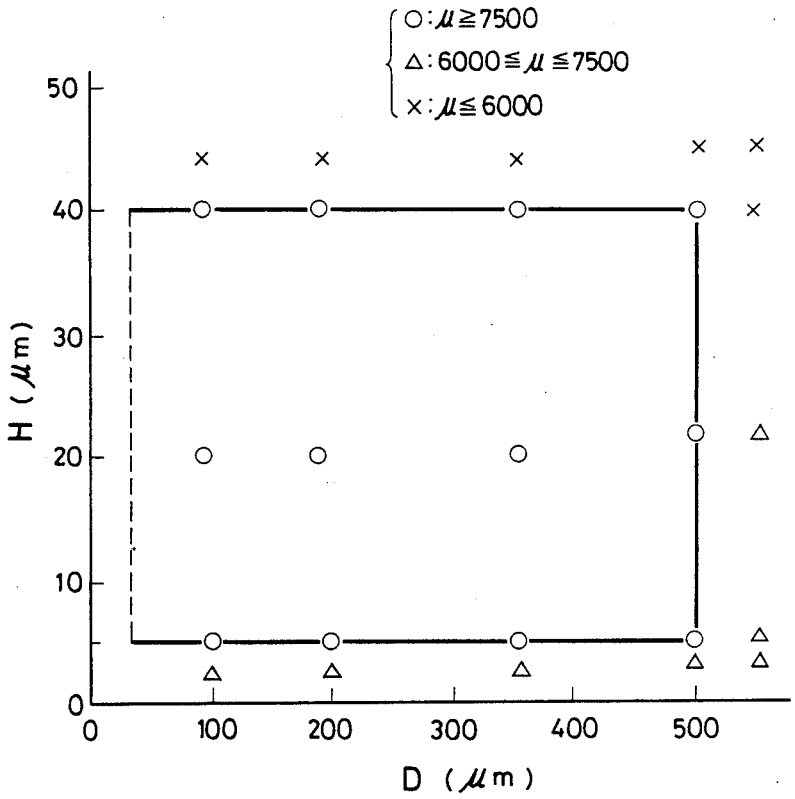
FIG. 5 is a chart showing the effect of the diameter of an equivalent circle D and the level difference between the most protuberant and the most recessed portions of the crater H on the magnetic permeability in the second aspect of the present invention.

FIG. 5 shows in an ordered fashion the results of investigations into the values of $\mu 15/50$ for various values of the diameter of an equivalent circle of the crater D and the difference H between the most protuberant and most recessed portions of the crater, for a constant value of the number of craters N of 300.

It is seen from this figure that highly satisfactory values of $\mu 15/50$ are obtained for the range $D \leqq 500$ microns and H=5 to 40 microns. It has also been confirmed that the anti-sticking properties are also excellent for the above range.

It is for this reason that the numerical limitations of $D \leqq 500$ microns, H=5 to 40 and N=1 to 400 have been adopted of the craters to be formed on the skin pass roll. Since D of less than 30 microns is extremely difficult to realize in the practical formation of the craters, it is more practical that the value of D be set so as to be not less then 30 microns.

Figure 6A:
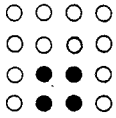
FIGS. 6 (a) to (i) illustrate several examples of the preferred crater dispositions according to the present invention.
Figure 6B:
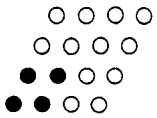
Figure 6C:
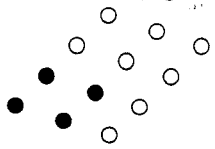
Figure 6D:
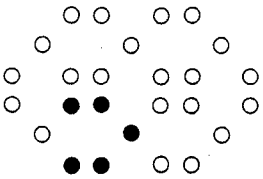
Figure 6E:
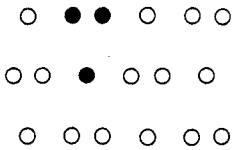
Figure 6F:
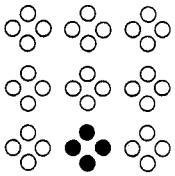
Figure 6G:
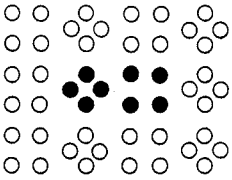
Figure 6H:
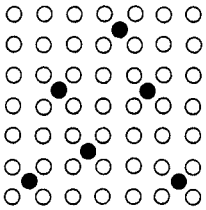
Figure 6I:
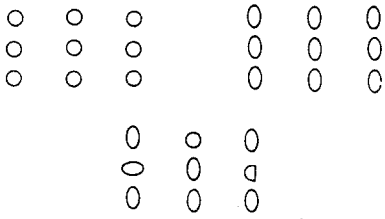
Figure 6I:
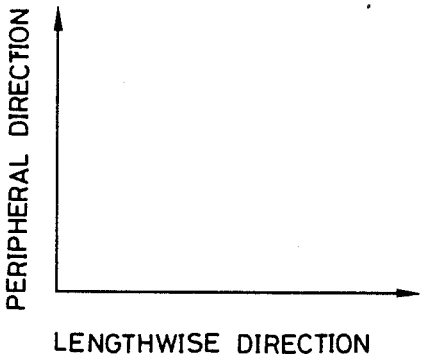

Finally, in FIGS. 6*a* to 6i, some preferred forms of the crater dispositions are shown highly schematically. Although it is preferred that the craters be of the same profile and arranged at constant intervals along the axial and circumferential directions of the roll, they may also be arranged at nonuniform intervals or dimensions, as shown in FIG. 6*h* or 6*i*, if to a limited extent.

The white dots and black dots illustrated in FIGS. 6*a* to 6*i* are illustrative of patterns of crater dispositions which can be formed on the roll surface. The black dots in FIGS. 6*a* to 6*g* show the repeating units that form the crater patterns. The black dots illustrated in FIG. 6*h* shows an irregular pattern of craters compared with a regularly arranged pattern (the white craters). FIG. 6*i*, shows groups of craters with differing shapes and with different shaped craters within a group.

For forming a dull roll, according to the present invention, a laser light beam or a plasma flame is most preferred.

EXAMPLES

The present invention will be explained with reference to several examples.

EXAMPLE 1

A hot-rolled sheet 2.3 mm thick and having a composition of C of 0.0050%, 0.52% of Si, 0.80% of Mn, 0.28% of Al and 0.05% of P and the balance being mainly Fe, was cold-rolled to a thickness of 0.53 mm. The cold-rolled sheet was then continuously annealed in a nitrogen atmosphere at 770° C. and for one minute and finished to a thickness of 0.50 mm by skin pass rolling.

The skin pass rolling was performed using various rolls with various values of the diameter of an equivalent circle D, the difference H between the most protuberant and recessed portions and of the number N of the craters, as shown in Table 1. It will be noted that the crater disposition having the pattern shown in FIG. 6a was used.

From the thus produced cold rolled sheets, ring-shaped test pieces or samples, each having an outside diameter of 100 mm and an inside diameter of 50 mm, were taken and subjected to stress relief annealing in a nitrogen atmosphere at 750° C. for two fours. These test pieces or samples were investigated as to magnetic permeability and iron losses. The results are shown in Table 1.

For comparison sake, Table 1 also shows the results of investigations obtained with the use of a ordinary bright roll and shot blast dull rolls having a mean centerline roughness Ra of 2.0, 3.0 and 4.0.

It is seen from the below Table that excellent magnetic properties along the circumferential direction may be accomplished especially in case of using a roll in which D, H. and N are within the optimum ranges defined in accordance with the present invention. t,0140

EXAMPLE 2

A hot-rolled plate 2.3 mm thick and a composition of 0.0040% of C, 0.50% of Si, 1.25% of Mn, 0.20% of Al, 0.030% of F, 0.0040% of S, 0.05% of Sb, 0.3% of Cu and 4% of Ni, the balance being predominantly Fe, was annealed in a nitrogen atmosphere at 850° C. and for five hours. The steel plate thus annealed was then processed in the same way as in Example 1 and the magnetic properties of the obtained ring-shaped sample were investigated. The results are shown in Table 2. t,0150

EXAMPLE 3

A hot-rolled sheet having a thickness of 2.3 mm and a composition containing 0.0050% of C, 0.52% of Si, 0.80% of Mn, 0.28% of Al and 0.05% of P and the balance being predominantly Fe, was cold-rolled to a thickness of 0.53 mm. The rolled product was then continuously annealed in a nitrogen atmosphere at 770° C. for one minute, and finished to a thickness of 0.50 mm by skin pass rolling.

This skin pass rolling was performed using rolls with various values of the diameter of an equivalent circle D, the difference H between the most protuberent and most recessed portions and the number N of the craters, as shown in Table 3. The crater disposition having the pattern as shown in FIG. 6a was used.

From the produced cold rolled sheets, epstein samples each having a width of 30 mm and a length of 280 mm were taken and subjected to stress relief annealing in a nitrogen atmosphere at 750° C. for 2 hours. The produced samples were checked as to the magnetic permeability and iron losses. The results are shown in Table 3.

Also, for evaluating the anti-sticking properties, shearing samples 30 × 100 mm in size were stacked one upon other with a lapping tolerance of 15 $cm^2$ and under an applied force of 500 kg. These samples were then annealed under the thus stacked and pressured state and under the aforementioned stress relief annealing conditions and checked for the sticking strength of the steel sheets using a tensile tester. The results are also shown in Table 3. The sticking strength of not higher than 10 $kg/cm^2$ is generally acceptable.

The results obtained with the conventional bright roll for comparison sake are also shown in Table 3.

It is seen from the above Table that excellent values of both the magnetic properties along the rolling direction and the anti-sticking properties may be obtained with the use of a roll in which the values of D, H and N are each within the optimum range according to the present invention. t,0170

EXAMPLE 4

A hot-rolled plate 2.3 mm thick and containing 0.0040% of C, 0.05% of Si, 1.25% of Mn, 0.20% of Al, 0.30% of P, 0.0040% of S, 0.05% of Sb, 0.3% of Cu, 0.4% of Ni and the balance predominantly of Fe, was annealed under a nitrogen atmosphere at 850° C. for 5 hours and then processed in the same way as in Example 3. The obtained samples were checked for the magnetic properties along the rolling direction and the sticking strength. The results are shown in Table 4. t,0180

EFFECT OF THE INVENTION

According to a first embodiment of the present invention, a semi-process electromagnetic steel sheet excellent in magnetic properties and above all in magnetic properties along the circumference of the steel sheet may be obtained and used effectively as the core material for rotational machines, such as small sized electric motors.

According to a second embodiment of the present invention, a semi-process electromagnetic steel sheet excellent in magnetic properties and above all in magnetic properties along the rolling direction of the steel sheet may be obtained and used effectively as the core material for a small-size transformer or the like electrical machines.

What we claim is:

1. A method for producing a semi-processed electromagnetic steel sheet, excellent in of ring-shaped pieces formed from the sheet, wt. % of C, 0.1 to 1.0 wt. % of Si, 0.5 to 1.5 wt. % of Mn, 0.1 to 0.6 wt. % of Al and 0.02 to 0.10 wt. % of P, and a balance of iron and inevitable impurities, wherein the skin pass rolling step is carried out with a roll in which a number of substantially non-overlapping craters each having a diameter of an equivalent circle of not larger than 200 microns are present on the roll surface and in which a level difference between the most protuberant and the most recessed portions of each of said craters is in the range from 5 to 40 microns, the number of the craters per square centimeter being not less than 1000.

2. The method according to claim 1 wherein said hot-rolled sheet further contains at least on element selected from the group consisting of Ni in an amount of 0.1 to 1.0 wt. %, Sb and/or Sn in an amount in sum of 0.01 to 0.2 wt. % and Cu in an amount of not more than 0.6 wt. %.

3. A method for producing a semi-processed electromagnetic steel sheet excellent in an ti-sticking properties and in magnetic properties along the rolling direction by series of process steps comprising cold rolling, annealing and skin pass rolling, in this order, a hot-rolling, steel sheet containing not more than 0.02 wt. % of C, 0.1 to 1.0 wt. % of Si, 0.5 to 1.5 wt. % of Mn, 0.1 to 0.6 wt. % of Al and 0.02 to 0.10 wt. % of P, and a balance of iron and inevitable impurities, wherein the skin pass rolling step is carried out with a roll in which a number of substantially non-overlapping craters each having a diameter of an equivalent circle of 30 to 500 microns, are present on the roll surface, and in which a level difference between the most protuberant and most recessed portions of each of said craters is in the range from 5 to 40 microns, with the number of the craters per square centimeter being in the range from 1 to 400.

4. The method according to claim 3 wherein said hot-rolled sheet further contains at least one element selected from the group consisting of Ni in an amount of 0.1 to 1.0 wt. %, Sb and/or Sn in an amount in sum of 0.01 to 0.2 wt. % and Cu in an amount of not more than 0.6 wt. %.

* * * * *

UNITED STATES PATENT AND TRADEMARK OFFICE

CERTIFICATE OF CORRECTION

PATENT NO. : 4,938,806

DATED : July 3, 1990

INVENTOR(S) : Atsuhito HONDA, Komatsubara KURASHIKI; Ko MATSUMURA

It is certified that error appears in the above-identified patent and that said Letters Patent is hereby corrected as shown below:

IN THE CLAIMS:

Claim 1, line 2, after "in" insert --magnetic properties along a circumferential direction--;

line 3, after "sheet," insert --by a series of process steps comprising, cold rolling, annealing and skin pass rolling, in this order, a hot-rolled steel heat containing not more than 0.02--.

Claim 3, line 2, change "an ti-sticking" to --anti-sticking--.

Signed and Sealed this

Fourth Day of June, 1991

*Attest:*

*Attesting Officer*

HARRY F. MANBECK, JR.

*Commissioner of Patents and Trademarks*